US011053874B2

(12) United States Patent
Urbanek et al.

(10) Patent No.: US 11,053,874 B2
(45) Date of Patent: Jul. 6, 2021

(54) ULTRA-LOW IDLE MANAGEMENT

(71) Applicant: Deere & Company, Moline, IL (US)

(72) Inventors: Justin J. Urbanek, Hazel Green, WI (US); Justin E. Fritz, Denver, IA (US); Patrick Keller, Platteville, WI (US); Brent M. Hunold, Asbury, IA (US)

(73) Assignee: DEERE & COMPANY, Moline, IL (US)

( * ) Notice: Subject to any disclaimer, the term of this patent is extended or adjusted under 35 U.S.C. 154(b) by 69 days.

(21) Appl. No.: 16/663,790

(22) Filed: Oct. 25, 2019

(65) Prior Publication Data

US 2021/0123390 A1 Apr. 29, 2021

(51) Int. Cl.

| | |
|---|---|
| ***F02M 41/08*** | (2006.01) |
| ***F02D 41/08*** | (2006.01) |
| ***F01N 11/00*** | (2006.01) |
| ***F02D 41/14*** | (2006.01) |

(52) U.S. Cl.

CPC ..... *F02D 41/086* (2013.01); *F01N 11/005* (2013.01); *F02D 41/08* (2013.01); *F02D 41/1459* (2013.01); *F02D 41/1493* (2013.01)

(58) Field of Classification Search

CPC ..... F02D 41/08; F02D 41/083

See application file for complete search history.

(56) References Cited

U.S. PATENT DOCUMENTS

| | | | | |
|---|---|---|---|---|
| 6,763,659 | B2 | 7/2004 | Watanabe et al. | |
| 7,971,570 | B2 | 7/2011 | Noda | |
| 7,980,066 | B2 | 7/2011 | Baird et al. | |
| 8,397,489 | B2 | 3/2013 | Webb et al. | |
| 8,631,642 | B2 | 1/2014 | Carlill et al. | |
| 8,631,643 | B2 | 1/2014 | Farman et al. | |
| 8,769,933 | B2 | 7/2014 | Thompson et al. | |
| 8,904,757 | B2 | 12/2014 | Sarsen et al. | |
| 9,068,494 | B2 * | 6/2015 | Karlsson | F01N 3/106 |
| 9,212,614 | B2 * | 12/2015 | Ancimer | F02D 41/0087 |
| 9,518,499 | B2 | 12/2016 | Dylhoff et al. | |
| 9,534,551 | B2 * | 1/2017 | Miura | F02D 41/029 |
| 10,037,634 | B2 | 7/2018 | Christofferson et al. | |
| 10,132,256 | B2 | 11/2018 | Swoish et al. | |
| 10,273,858 | B2 | 4/2019 | Hall et al. | |
| 2003/0217549 | A1 * | 11/2003 | Watanabe | F01N 3/035 60/285 |
| 2004/0237513 | A1 * | 12/2004 | Bunting | B60L 3/0023 60/295 |

(Continued)

FOREIGN PATENT DOCUMENTS

| | | | |
|---|---|---|---|
| JP | 2012140877 | A | 7/2012 |

OTHER PUBLICATIONS

European Search Report issued in counterpart application No. 20198722.9 dated Mar. 15, 2021 (09 pages).

*Primary Examiner* — Thomas N Moulis

(57) ABSTRACT

A work vehicle may include an internal combustion engine, aftertreatment system, and at least one controller. The controller is configured to use a temperature of the aftertreatment system to determine a hydrocarbon level of the aftertreatment system, and set an idle speed of the engine to high idle if the hydrocarbon level is above a hydrocarbon ceiling, to ultra-low idle if the hydrocarbon level is below a hydrocarbon floor, and to low idle if the hydrocarbon level is between the hydrocarbon floor and the hydrocarbon ceiling.

20 Claims, 6 Drawing Sheets

(56) References Cited

U.S. PATENT DOCUMENTS

| | | | | |
|---|---|---|---|---|
| 2005/0050883 | A1* | 3/2005 | Nishimura | F02D 41/029 60/286 |
| 2007/0186538 | A1* | 8/2007 | Dollmeyer | F02D 41/029 60/285 |
| 2007/0193258 | A1* | 8/2007 | Berke | F01N 9/002 60/297 |
| 2007/0214772 | A1* | 9/2007 | England | F02D 41/086 60/285 |
| 2007/0234711 | A1* | 10/2007 | Berke | F01N 3/023 60/295 |
| 2007/0271906 | A1* | 11/2007 | Berke | F02D 41/029 60/285 |
| 2009/0222191 | A1* | 9/2009 | Andrasko | B60K 28/16 701/102 |
| 2011/0146245 | A1 | 6/2011 | Farman et al. | |
| 2011/0146246 | A1 | 6/2011 | Farman et al. | |
| 2012/0227379 | A1 | 9/2012 | Koestler | |
| 2013/0073177 | A1* | 3/2013 | Thompson | F02D 28/00 701/102 |
| 2015/0032356 | A1* | 1/2015 | Jerger | B60W 30/18054 701/101 |
| 2016/0016562 | A1* | 1/2016 | McKnight | B60T 7/042 701/70 |
| 2016/0084135 | A1 | 3/2016 | Harmon et al. | |
| 2016/0097313 | A1* | 4/2016 | Im | F01N 3/20 60/274 |

* cited by examiner

ULTRA-LOW IDLE MANAGEMENT

TECHNICAL FIELD

The present disclosure generally relates to a system and method for controlling an engine. An embodiment of the present disclosure relates to efficient management of ultra-low idling for an engine.

BACKGROUND

An engine for a work vehicle may have an aftertreatment system installed to treat the exhaust gas of the engine to reduce or remove certain unwanted components of the gas. The performance of this aftertreatment system may vary with engine load, exhaust temperature, and exhaust flow, such that hydrocarbons may accumulate or oxidize in the aftertreatment system depending on the conditions. Such aftertreatment systems may have sensors installed which can be monitored by a controller to use in estimating the accumulation of hydrocarbons, or hydrocarbon level, and taking action to manage the hydrocarbon level.

While a work vehicle is not performing a task, its engine speed may be reduced to a low idle to conserve fuel if there is no demand or load on the engine necessitating a higher engine speed. A controller managing the hydrocarbon level in an aftertreatment system may be configured to prevent the engine speed from dropping to this low idle, and may instead prevent the engine speed from falling below a high idle engine speed, because this raised idle speed may help maintain a higher temperature in the aftertreatment system to slow, prevent, or reverse the accumulation of hydrocarbons.

Certain vehicles may include a feature enabling the engine speed to drop further to an ultra-low idle if certain conditions are met, for example an extended period of idle time. Ultra-low idle may offer opportunities for the conservation of fuel, but may have interactions with the control of the hydrocarbon level of the aftertreatment system.

SUMMARY

Various aspects of examples of the present disclosure are set out in the claims.

According to a first aspect of the present disclosure, a work vehicle may include an internal combustion engine, an aftertreatment system, and at least one controller. The aftertreatment system may be configured to treat exhaust gas from the engine. The at least one controller may be in communication with the engine and the aftertreatment system, and configured to determine a hydrocarbon level of the aftertreatment system, set an idle speed of the engine to high idle if the hydrocarbon level is above a hydrocarbon ceiling, set an idle speed of the engine to ultra-low idle if the hydrocarbon level is below a hydrocarbon floor, the hydrocarbon level of the hydrocarbon floor less than the hydrocarbon level of the hydrocarbon ceiling, and set the idle speed of the engine to low idle if the hydrocarbon level is between the hydrocarbon ceiling and the hydrocarbon floor, the engine speed at low idle greater than the engine speed at ultra-low idle, the engine speed at low idle less than the engine speed at high idle.

According to a second aspect of the present disclosure, a method of controlling an internal combustion engine with an aftertreatment system configured to treat exhaust gas from the engine may include: (a) determining a current temperature of the aftertreatment system, (b) estimating, using the current temperature of the aftertreatment system, whether a future temperature of the aftertreatment system will be below a minimum aftertreatment temperature, (c) setting an idle speed of the engine to high idle if the current temperature of the aftertreatment system is below the minimum aftertreatment temperature, (d) setting the idle speed of the engine to ultra-low idle if (i) the idle speed is not set to high idle and (ii) the future temperature of the aftertreatment system is estimated to not be below the minimum aftertreatment temperature, and (e) setting the idle speed of the engine to low idle if it is not set to ultra-low idle or high idle, the engine speed at ultra-low idle less than the engine speed at low idle, the engine speed at high idle greater than the engine speed at low idle.

The above and other features will become apparent from the following description and accompanying drawings.

BRIEF DESCRIPTION OF THE DRAWINGS

The detailed description of the drawings refers to the accompanying figures in which.

DETAILED DESCRIPTION

At least one example embodiment of the subject matter of this disclosure is understood by referring to FIGS. 1 through 5 of the drawings.

Figure 1:
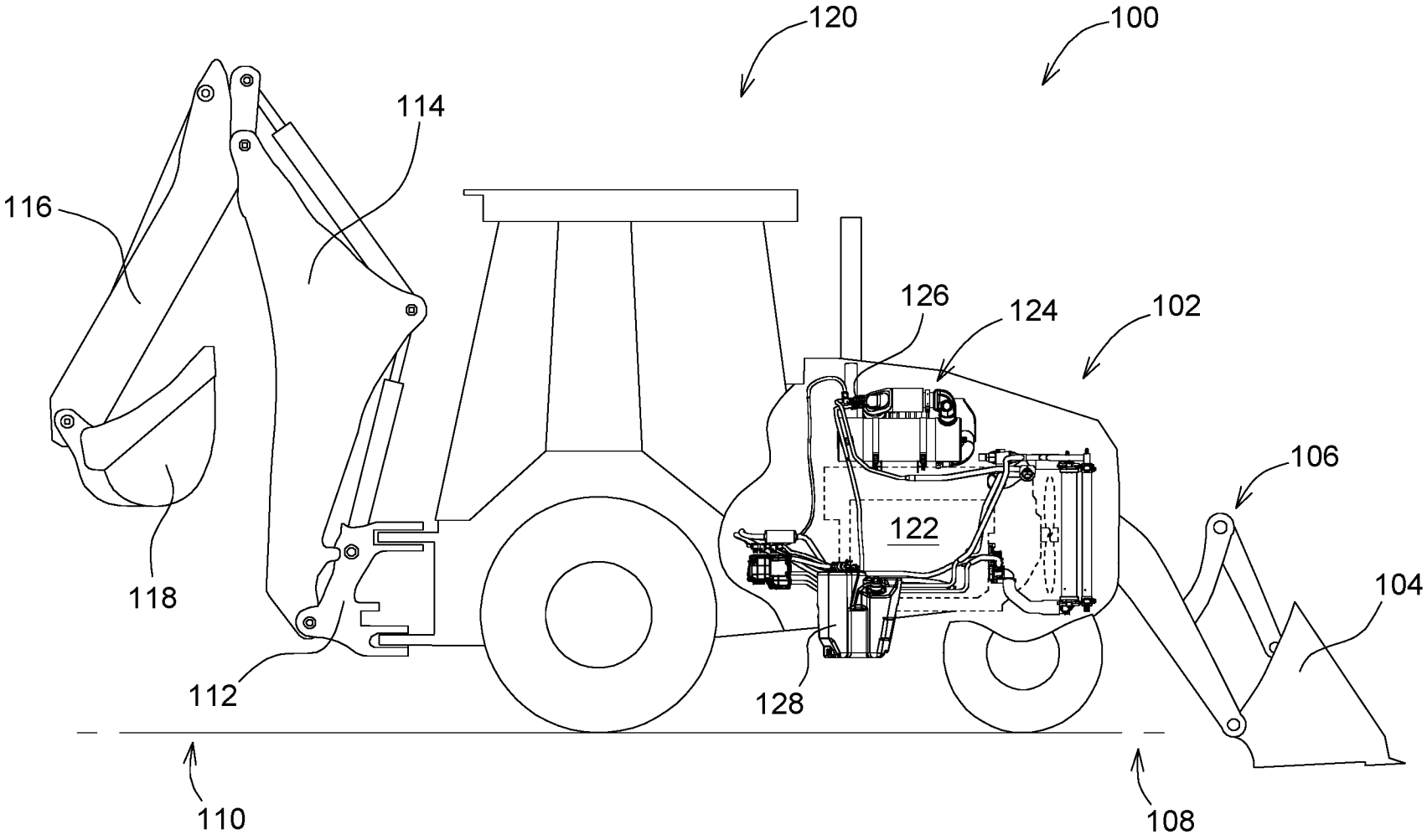
FIG. 1 is a side view of an embodiment of a work vehicle, with its body cut away to reveal an engine and aftertreatment system.

FIG. 1 illustrates a work vehicle 100, which is illustrated here as a backhoe loader. In alternative embodiments, the work vehicle 100 may be any work vehicle with an engine and aftertreatment system, such as an articulated dump truck, compact track loader, crawler (e.g., crawler dozer, crawler loader), excavator, feller buncher, forwarder, harvester, knuckleboom loader, motor grader, scraper, skidder, sprayer, skid steer, tractor, tractor loader, and wheel loader, to name a few work vehicles. Work vehicle 100 comprises a chassis 102, such as a frame or unibody construction, which provides structure, strength, rigidity, and attachment points for work vehicle 100.

Connected to the front of work vehicle 100 is a work tool 104. The work tool 104 is illustrated as a bucket, but may be any number of other work tools such as forks, a blade, an auger, or a hammer, to name a few work tools. The work tool 104 is movably connected to the chassis 102 via a linkage 106, which is comprised of multiple rigid members pivotally connected to each other, the chassis 102, and the work tool 104. The linkage 106 allows the work tool 104 to be raised and lowered relative to the chassis 102 as well as tilted forward or backward. For example, the linkage 106 may be actuated to tilt the work tool 104 backward to gather material or forward to dump such material. The linkage 106, and the work tool 104, may be raised or lowered relative to the chassis 102 by lift cylinders and the work tool 104 may be tilted relative to the chassis 102 by a tilt cylinder. The work tool 104, the linkage 106, the lift cylinders, and tilt cylinder may collectively be referred to as a loader assembly 108.

Connected to the rear of the work vehicle 100 is a backhoe assembly 110, comprising a swing frame 112, a boom 114, a dipperstick 116, and a work tool 118. The swing frame 112 pivotally attaches the backhoe assembly 110 to the chassis 102 so as to allow the backhoe assembly 110 to pivot left and right relative to an operator sitting in an operator station 120 of the work vehicle 100. The boom 114 is pivotally connected to the swing frame 112 at a first end and extends vertically and rearwardly from the swing frame 112 to pivotally connect to the dipperstick 116 at a second end. This allows the boom 114 to pivot about a substantially horizontal axis relative to the work vehicle 100, allowing the boom 114 to be raised toward a vertical position and lowered toward a horizontal position. The dipperstick 116 is similarly pivotally connected to the boom 114 about a substantially horizontal axis relative to the work vehicle 100 at a first end and extends towards a pivotal connection with the work tool 118 at a second end. The range of motion for the dipperstick 116 allows it to be pivoted so as to form a narrow V-shape with the boom 114 which positions the second end of the dipperstick 116 (and the work tool 118) close to the swing frame 112, or to be pivoted so as to form nearly a straight line with the boom 114 which positions the second end of the dipperstick 116 (and the work tool 118) far from both the swing frame 112 and the boom 114. The work tool 118 is illustrated as a bucket, but may be any number of different kinds of work tools. In FIG. 1, the work tool 118 is pivotally connected directly to the dipperstick 116, but in alternative embodiments the work tool 118 may pivotally connect to the dipperstick 116 via a coupler or other intermediate component. Hydraulic cylinders may be used to actuate the boom 114, the dipperstick 116, and the work tool 118.

The work vehicle 100 is powered by an internal combustion engine 122, which in this embodiment is a turbocharged diesel engine. The engine 122 powers the work vehicle 100 through components rotatably coupled to the engine 122, such as transmissions, hydraulic pumps, water pumps, and alternators or inverters. These components may be rotatably coupled to the engine 122 via splines or other gearing which allows torque to be transmitted and thereby drive the components.

Exhaust gas from the engine 122 flows through an aftertreatment system 124, which is configured to treat this exhaust gas to reduce or remove certain components, such as particulates and nitrogen oxides. The aftertreatment system 124 includes a selective catalytic reduction system (SCR) 126, which receives diesel exhaust fluid (DEF) from a DEF tank 128 and injects the received DEF through nozzles or other apertures into the exhaust stream of the engine 122 where it can mix with the exhaust gas and react with certain components. The temperature at which the DEF mixes with the exhaust gas affects the chemical reactions taking place between the DEF and exhaust gas (in particular the nitrogen oxides), so there is often a target temperature range throughout which this reaction is desired to take place.

Figure 2:
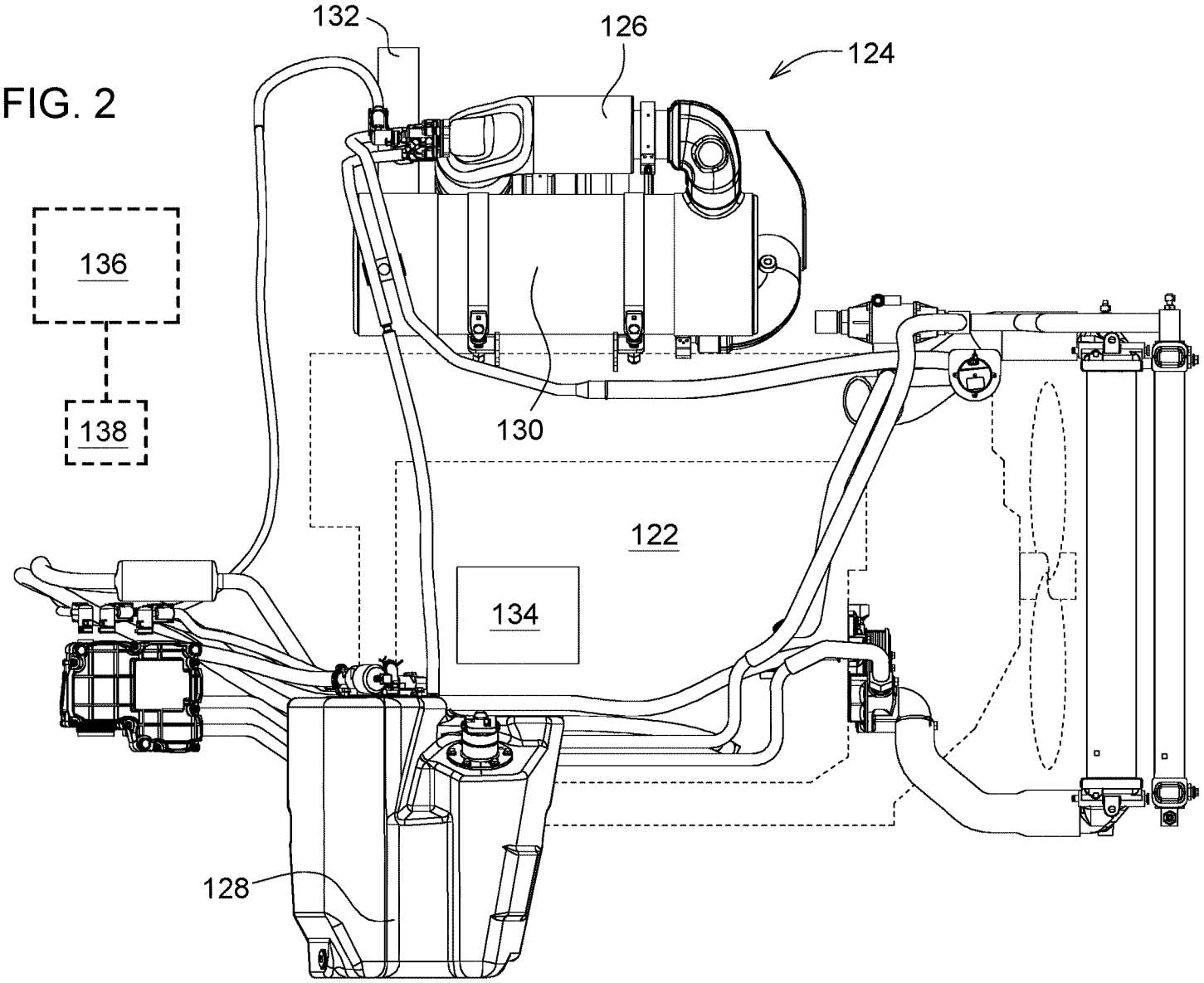
FIG. 2 is a side view of the engine and aftertreatment system.

FIG. 2 illustrates a simplified version of the engine 122 and the aftertreatment system 124. DEF is stored in the DEF tank 128, then pumped up to the SCR 126 where it is injected into the exhaust gas of the engine 122. In this embodiment, the exhaust gas of the engine 122 passes through a diesel particulate filter (DPF) 130 then the SCR 126 before being expelled to the outside through the exhaust pipe 132. Certain of the components responsible for handling DEF are described further in U.S. Pat. No. 9,518,499, which is hereby incorporated by reference.

In communication with the engine 122 is an engine control unit (ECU) 134, which may also be referred to as a controller. The ECU 134 controls and monitors engine 122 via its communication (e.g., through a vehicle data bus) with multiple components associated with engine 122 or its operating state, such as sensors and solenoids. The ECU 134 is provided with input signals from sensors configured to sense various operating states or characteristics of the engine 122 (e.g., rotational speed, temperatures, pressures) or the aftertreatment system 124 (e.g., temperatures, pressures), as well as using vehicle inputs (e.g., throttle position, requested engine speed, requested engine power). The ECU 134 uses these inputs to control the engine 122 and the aftertreatment system 124, including controlling some aspects directly (e.g., engine speed, engine power, fueling, DEF dosing) and other aspects indirectly (e.g., temperatures of the engine 122, temperatures of the aftertreatment system 124).

The ECU 134 may communicate with a Vehicle Control Unit (VCU) 136, such as through a vehicle data bus such as a controller area network (CAN) or a wireless network, including exchanging data messages (e.g., input and commands). The VCU 136 is in communication with the data messages and sensor data associated with the engine 122 via the ECU 134 such that the VCU 136 may receive signals indicative of the state or performance of the engine 122. The VCU 136 may thereby receive signals from the ECU 134 indicative of operating characteristics of the engine 122, such as CAN messages communicating the speed of engine 122 (i.e., the rotational speed of the crankshaft of the engine 122), its power output, and the temperature at certain locations or of certain components of the engine 122 and the aftertreatment system 124. For example, the ECU 134 may send CAN messages indicative of temperatures of the engine 122, which may be based on signals from temperature sensors configured to measure the temperature of the oil, coolant, or block of the engine 122, of the SCR 126 of the aftertreatment 124, or the exhaust flowing through the exhaust pipe 132.

The VCU 136 controls and monitors multiple aspects of the work vehicle 100 via its communication with multiple components on board the work vehicle 100, such as sensors and solenoids. These inputs include sensors across the work vehicle 100 (e.g., position sensors, cameras, GNSS receivers) that can provide signals which can be used to execute algorithms to control the work vehicle 100, such as its speed or how it performs a work task. The VCU 136 is in communication with an ambient temperature sensor 138, which is positioned and configured so as to measure the ambient temperature of the surroundings of the work vehicle 100, which may also be referred to as the environmental temperature, atmospheric temperature, or external temperature. The temperature sensor 138 may be positioned remotely from hot or cold components of the work vehicle 100 to enable it to better measure the temperature of the air surrounding the work vehicle 100 without interference from local thermal sources. The temperature sensor 138 communicates the ambient temperature to the VCU 136 via a voltage signal carried on a wiring harness electrically interconnecting the temperature sensor 138 and the VCU 136. The VCU 136 receives this ambient temperature signal and determines the corresponding ambient temperature it indicates by using a data structure, e.g., a lookup table which maps the voltages received from the temperature sensor 138 to associated temperatures. In alternative embodiments, the ambient temperature signal may be another electrical signal, e.g., a CAN message indicating a value corresponding to the sensed ambient temperature. In other alternative embodiments, the ambient temperature may be determined from a wireless signal received from an off-board source which indicates the air temperature in the area of the work vehicle 100.

Figure 3:
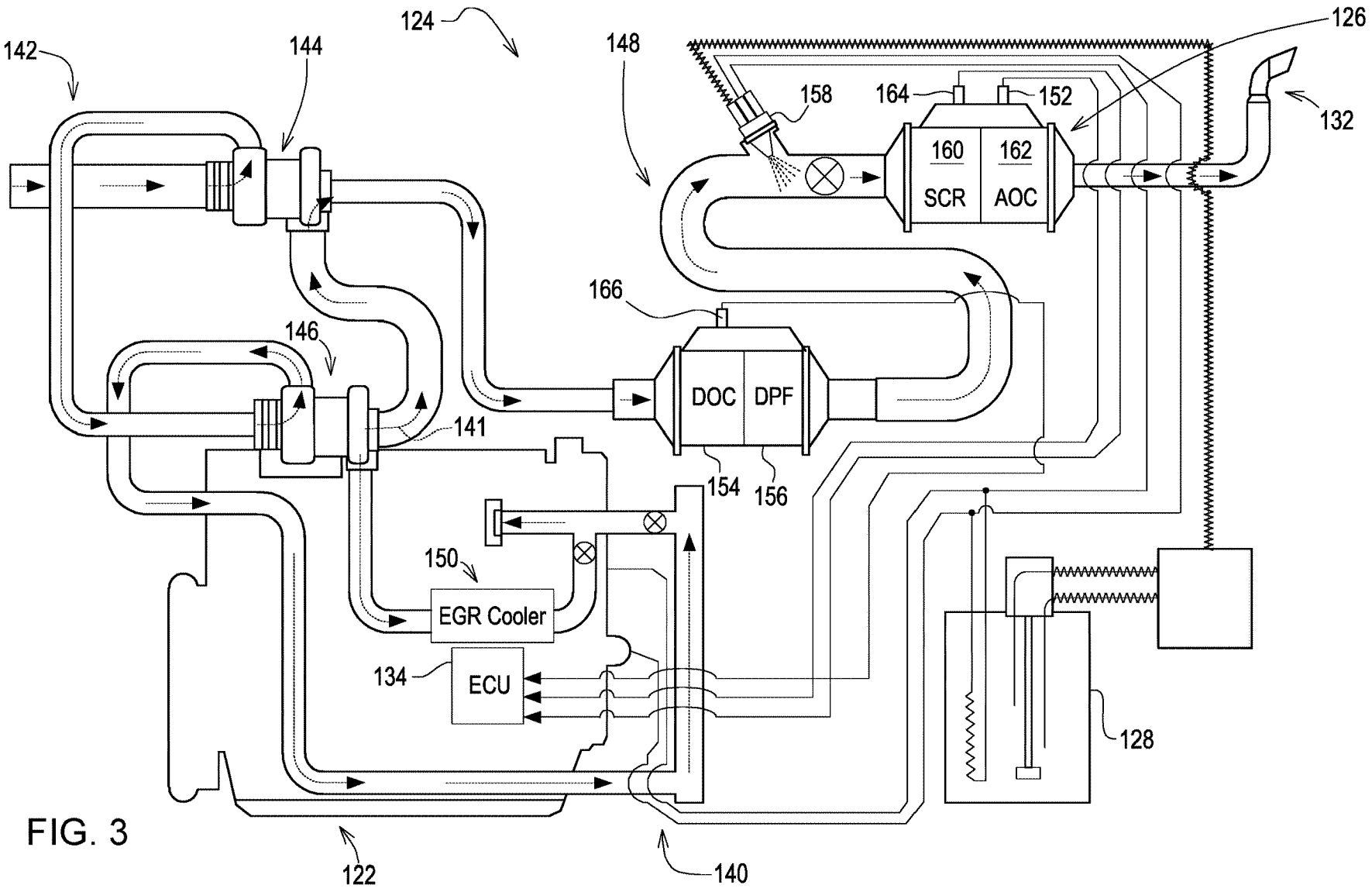
FIG. 3 is a schematic of the illustrative engine and aftertreatment system comprising a selective catalytic reduction (SCR) system and a diesel oxidation catalyst (DOC) system.

FIG. 3 is a schematic illustration of a power system 140, which includes the engine 122, the aftertreatment system 124 and other components, further detail for which is provided in U.S. Pat. No. 9,145,818, which is hereby incorporated by reference. The engine 122 produces an exhaust gas, as indicated by directional arrow 141. In this embodiment, engine 122 comprises a diesel engine, but in other embodiments it may be a gasoline engine, a gaseous fuel burning engine (e.g., natural gas), or any other exhaust gas producing engine. The engine 122 may be of a range of sizes from 2-25 liters of displacement, with any number of cylinders (not shown), and in any configuration (e.g., "V," inline, radial). The engine 122 may include various sensors, such as temperature sensors, pressure sensors, and mass flow sensors, only some of which are shown in FIG. 3.

The power system 140 comprises an intake system 142 including a first turbocharger 144 and a second turbocharger 146, which may each comprise a fixed geometry compressor, a variable geometry compressor, or any other type of compressor that is capable of compressing the fresh intake gas to an elevated pressure level. The power system 140 also includes an exhaust system 148, which has components for directing exhaust gas from the exhaust of the engine 122 to the atmosphere. The power system 140 also has an EGR system 150 for receiving a recirculated portion of the exhaust gas from the engine 122.

The exhaust system 148 comprises an aftertreatment system 124, and at least some of the exhaust gas passes therethrough. The aftertreatment system 124 removes various chemical compounds and particulate emissions present in the exhaust gas received from the engine 122. After being treated by the aftertreatment system 124, the exhaust gas is expelled into the atmosphere via the exhaust pipe 132. The aftertreatment system 124 may include a NOx sensor 152 which produces and transmits a NOx signal to the ECU 134, indicative of a NOx content of exhaust gas flowing thereby. Exemplarily, the NOx sensor 152 may rely upon an electrochemical or catalytic reaction that generates a current, the magnitude of which is indicative of the NOx concentration of the exhaust gas.

Among others, the ECU 134 has one or more of the following functions: (1) converting analog sensor inputs to digital outputs, (2) performing mathematical computations for all fuel and other systems, (3) performing self diagnostics, and (4) storing information. The ECU 134 may, in response to the NOx signal, control a combustion temperature of the engine 122 and/or the amount of a reductant injected into the exhaust gas.

The aftertreatment system 124 illustrated has a diesel oxidation catalyst (DOC) 154, a diesel particulate filter (DPF) 156, and the SCR 126, though the need for such components depends on the particular size and application of the power system 140. The SCR 126 has a reductant injector 158, an SCR catalyst 160, and an ammonia oxidation catalyst (AOC) 162. The exhaust gas may flow through the DOC 154, the DPF 156, the SCR catalyst 160, and the AOC 162, and then expelled into the atmosphere via the exhaust pipe 132. Exhaust gas that is treated in the aftertreatment system 124 and released into the atmosphere contains significantly fewer pollutants (e.g., PM, NOx, and hydrocarbons) than untreated exhaust gas. The reductant injector 158 is positioned upstream of the SCR catalyst 160. The reductant injector 158 may be, for example, an injector that is selectively controllable to inject reductant directly into the exhaust gas. An SCR temperature sensor 164 is configured to sense a temperature of the aftertreatment system 124, specifically a temperature of the SCR 126, and provide a signal indicative of this temperature to the ECU 134 (e.g., via a wiring harness or a data bus). A DOC temperature sensor 166 is configured to sense another temperature of the aftertreatment system 124, specifically a temperature of the DOC 154, and provide a signal indicative of this temperature to the ECU 134.

Figure 4:
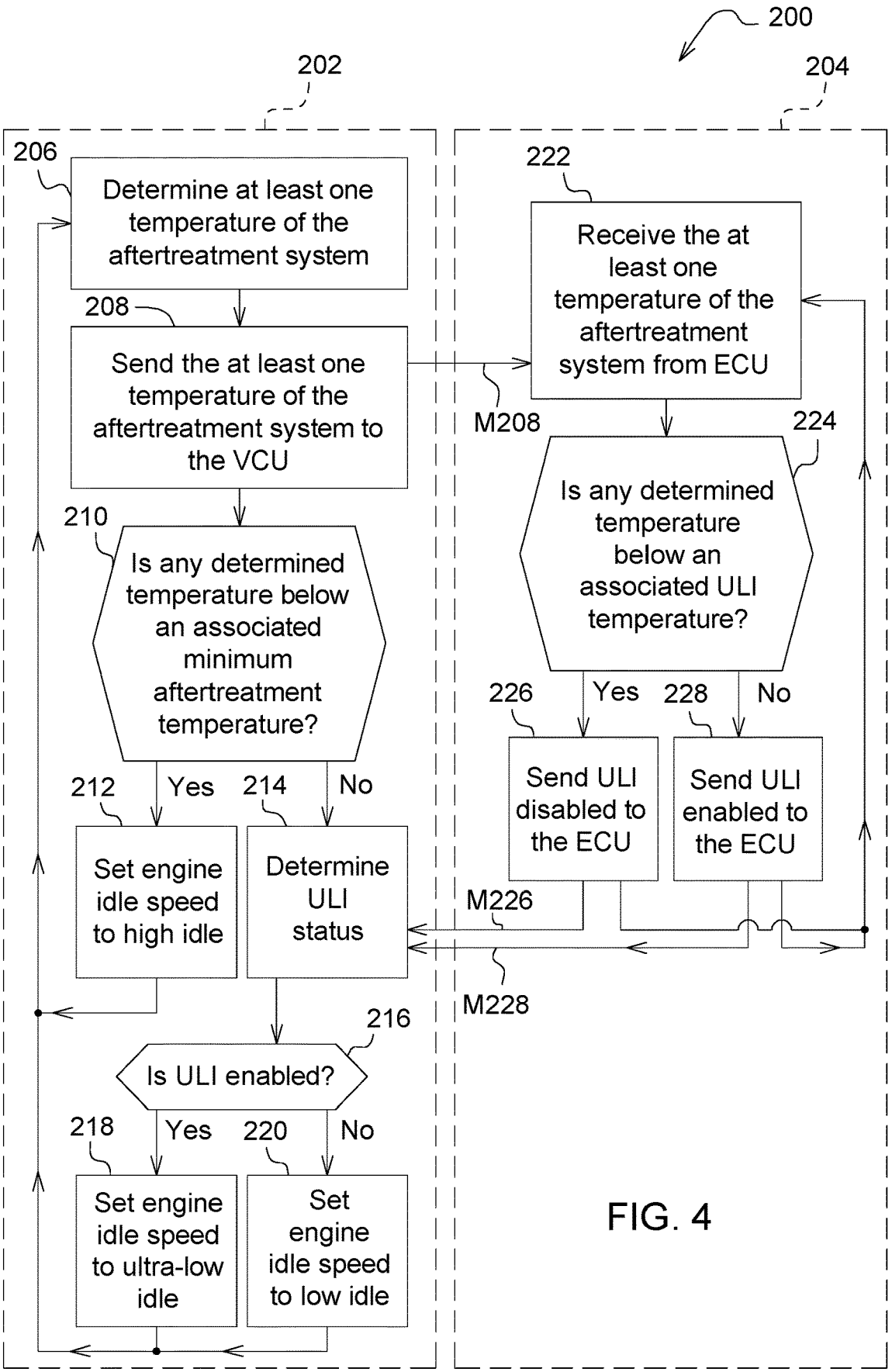
FIG. 4 is a flowchart of a first embodiment of a method for managing ultra-low idle of the engine.
Figure 5:
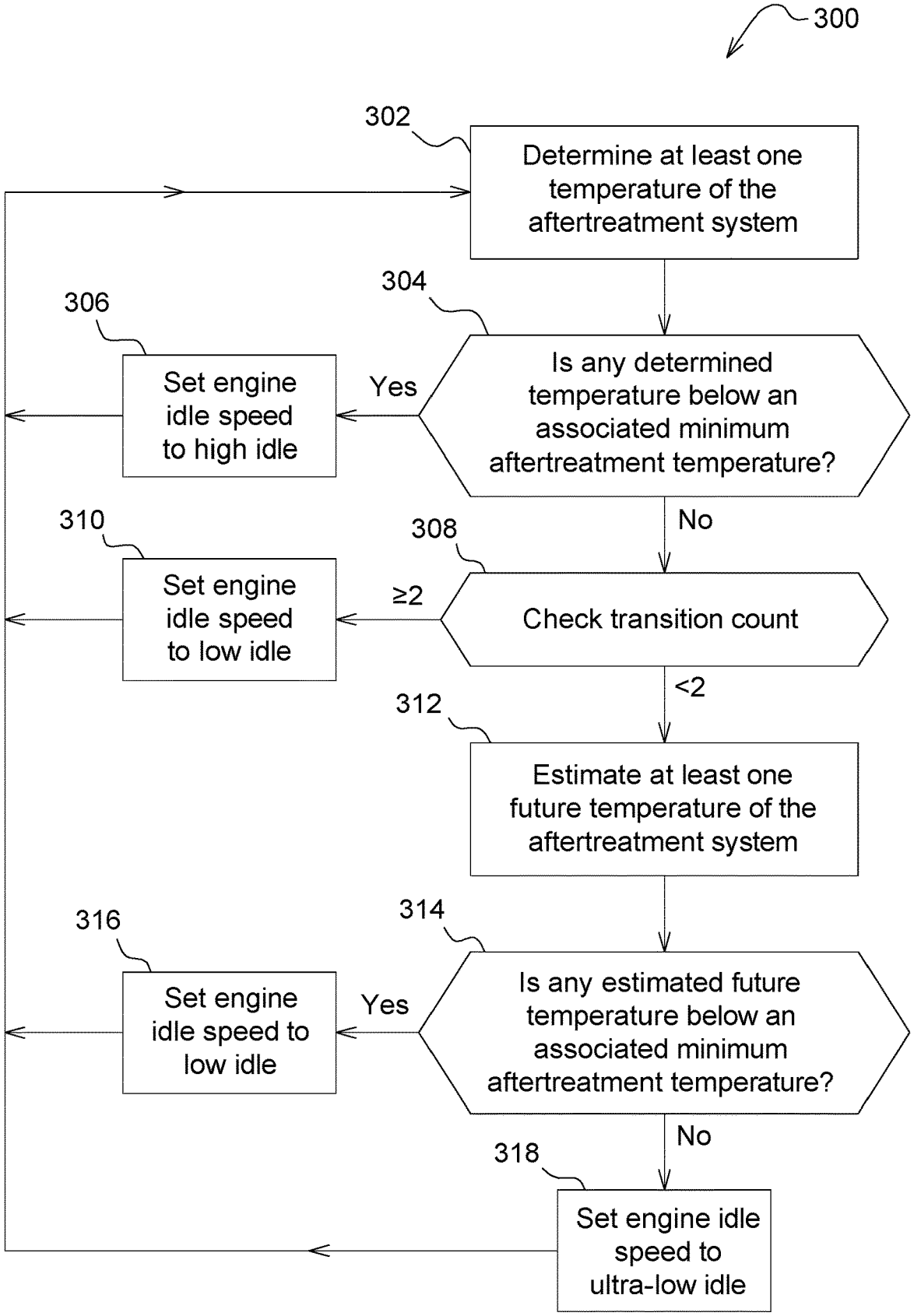
FIG. 5 is a flowchart of a second embodiment of a method for managing ultra-low idle of the engine.
Figure 6:
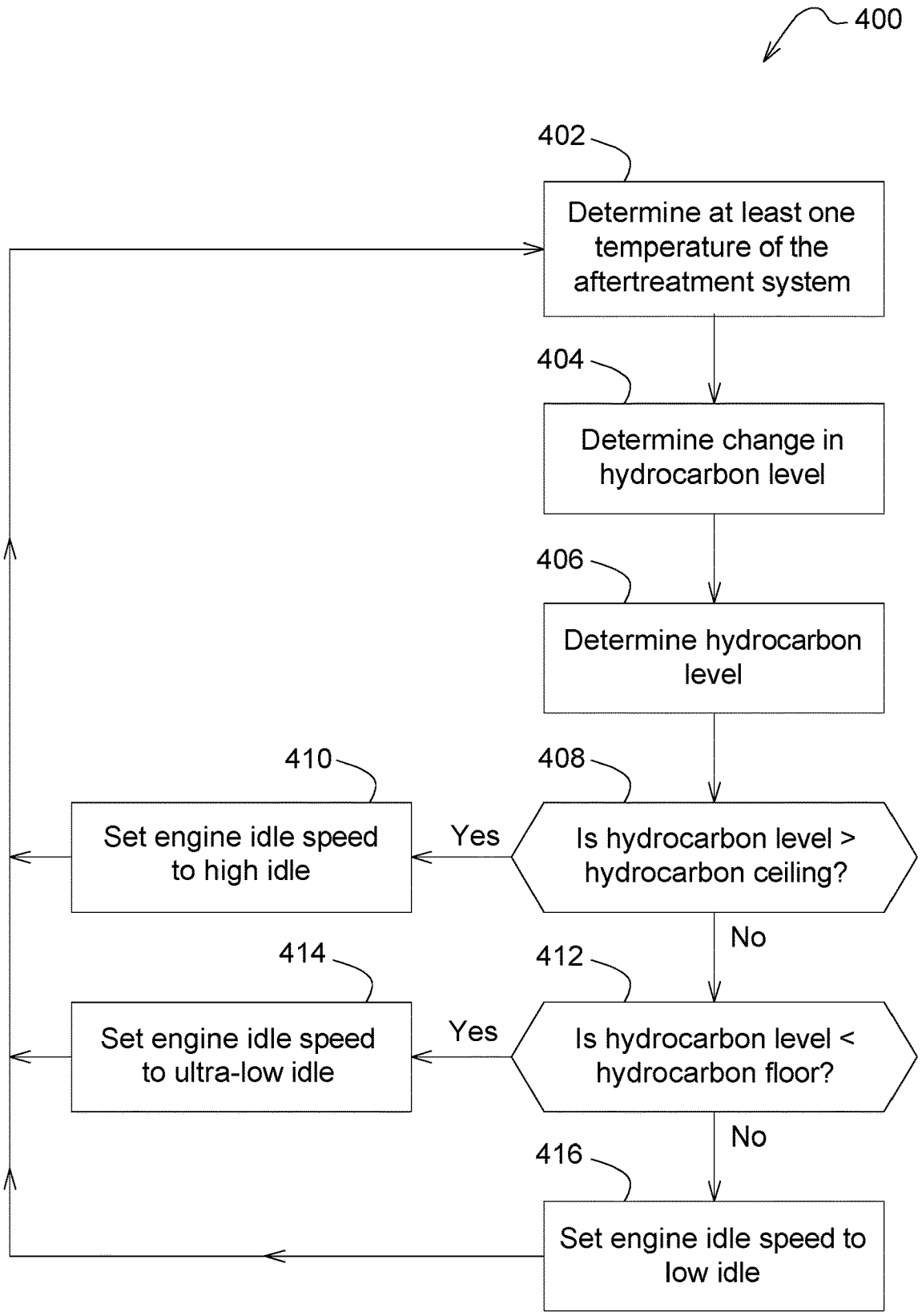
FIG. 6 is a flowchart of a third embodiment of a method for managing ultra-low idle of the engine; and Like reference numerals are used to indicate like elements throughout the several figures.

FIGS. 4-6 are flowcharts of different embodiments of control systems which may be executed by at least one controller, such as through the cooperation of the ECU 134 and the VCU 136, or by a single controller. The control systems set the target speed of the engine 122 when it is running in a standby or low-power state, commonly referred to as idling or at idle. The control systems therefore control the setting of the idle speed of the engine 122, or the rotational speed of the engine while it is idling. In these embodiments, the engine 122 may be operated at a low idle, high idle, or ultra-low idle. Low idle is a standard or default idle speed which would be utilized when the specific conditions for enabling high idle or ultra-low idle are not present. High idle utilizes an idle speed above that of low idle and, in these control systems, is utilized to avoid or reverse excess accumulation of hydrocarbons in the aftertreatment system 124. Ultra-low idle utilizes an idle speed below that of low idle and, in these control systems, is utilized when it may allow for increased fuel savings due to the lower fuel consumption of the engine 122 at reduced speeds.

The target idle speeds at each of low idle, high idle, and ultra-low idle may vary by engine and application, and may be influenced by factors such as engine type, size, and number of cylinders. In the embodiments illustrated in FIGS. 4-6, which involve diesel engines in the range of 2 to 25 liters of displacement, low idle is 785-1049 rotations per minute (RPM), high idle is 1050-1300 RPM, and ultra-low idle is below 785 RPM, although other embodiments may involve different speed ranges for the various idles. When at each of these idles, the speed of the engine 122 will average within the range over a period time (e.g., 10 seconds) but temporary fluctuations below or above the range can occur. For example, rapidly adding a load on the engine 122 may temporarily slow the engine speed until the ECU 134 can adjust to the load. Conversely, rapidly removing a load on the engine 122 may temporarily increase the engine speed.

In these embodiments, maintaining the engine 122 at the selected idle speed is handled by a separate control system, which can be any of a number of control systems known in the art for controlling the speed of an engine around a target speed. As one example, the control system for maintaining idle speed could be a proportional control which increases the power output of the engine 122 proportional to its droop below the target idle speed, and conversely decreases the power output of the engine 122 proportional to its rise above the target idle speed. As other examples, the control system for maintaining idle speed could be a PI (proportional integral) or PID (proportional integral derivative) control, which determine the difference between the target idle speed to the actual idle speed, which may be referred to as the error, and then adjust the power output of the engine based on one or more of (i) a product of a first constant and the error, (ii) a product of a second constant and the integration of the error over time, and (iii) a product of a third constant and a derivative of the error over time.

FIG. 4 is a flowchart of a control system 200 which is executed by a combination of the ECU 134 and the VCU 136 in cooperation with each other. Subsystem 202 is executed by the ECU 134 and subsystem 204 is executed by the VCU 136, with the two subsystems in communication with each other over a CAN and exchanging information as part of the control system 200.

In subsystem 202, the ECU 134 determines at least one temperature of the aftertreatment system 124 in step 206. In this embodiment, the ECU 134 is electrically connected to the SCR temperature sensor 164 and the DOC temperature sensor 166 through a wiring harness. The ECU 134 receives a temperature signal indicative of the temperature of the SCR 126 and the DOC 154 (a sensed temperature) from the SCR temperature sensor 164 and the DOC temperature sensor 166, respectively, in the form of a voltage between 0.5 volts and 4.5 volts which corresponds to an associated temperature range. While this embodiment controls the setting of idle speed based on these two temperatures, other embodiments may use any number of temperatures of the aftertreatment system 124 (e.g., 1, 2, 3, 4) and those temperatures may indicate temperatures of any number of components or locations within the aftertreatment system 124.

In alternative embodiments, the ECU 134 may estimate a current temperature, which may correlate to an actual temperature of a component such as the SCR 126, but may also just be a general or non-specific temperature of the aftertreatment system 124 useful for control or computational purposes. Estimating the current temperature of a specific component, such as the SCR 126, using a computational model may be desired in certain applications, for example if directly sensing that temperature with a sensor is difficult due to the packaging of the aftertreatment system 124 or if the environment in the area being sensed is challenging for the survival of a temperature sensor. Determining at least one temperature of the aftertreatment system 124 by estimating a current temperature which is general or non-specific may be desired in other applications, for example if it is desirable that the temperature not represent that of any specific component or complex computational models do not improve accuracy or robustness to warrant additional development or computing resources.

In step 208, the ECU 134 provides this temperature information to the VCU 136 through the CAN. Specifically, the ECU 134 sends CAN message M208 containing temperature information to the VCU 136. Message M208 may be sent at regular intervals (e.g., every 30 seconds), only when the temperature has changed, or only upon receiving a temperature information request message form the VCU 136.

After sending the temperature information to the VCU 136 in step 208, the ECU 134 continues to step 210 where it evaluates the hydrocarbon level of the aftertreatment system 124. The "hydrocarbon level" represents an estimate of the amount of hydrocarbons in the aftertreatment system 124, and can be calculated in different ways in different embodiments, as explained with regard to the control system 200, the control system 300, and the control system 400. In the control system 200, the hydrocarbon level is high (above a hydrocarbon ceiling) if either the temperature of the SCR 126 or the temperature of the DOC 154 is below an associated minimum aftertreatment temperature. In this embodiment, the SCR 126 has a minimum aftertreatment temperature of 175 degrees Celsius and the DOC 154 has a minimum aftertreatment temperature of 175 degrees Celsius, which may be referred to as low temperature thresholds. These minimum aftertreatment temperatures may be predefined and selected based on the particular components comprising the aftertreatment system 124 and the intended application of the engine 122 or the work vehicle 100. The values selected for these minimums may be chosen to achieve different aims, for example they could represent the lowest temperatures to avoid damage to the component, to provide at least some removal or reduction of components in the exhaust gas, to provide a desired level of removal or reduction, or for the overall aftertreatment system 124 to achieve a desired level of performance. In this embodiment, the minimum temperatures are the same for the two different components from which the temperatures were taken, but in other embodiments the minimums may be the different and multiple temperatures may be taken to ensure that no part of the aftertreatment system 124 falls below a certain minimum temperature.

If the ECU 134 determines that any of the determined temperatures from step 206 are below their associated minimum temperature, in this case if either the SCR 126 is below 175 degrees Celsius or the DOC 154 is below 175 degrees Celsius, then the ECU 134 determines the hydrocarbon level is high and proceeds to step 212. Otherwise, the ECU 134 proceeds to step 214.

If the ECU 134 proceeded to step 212, it will set the engine idle speed to high idle and then cycle the control system 200 back to step 206. In this way, the control system 200 will cycle between steps 206, 208, 210, and 212 until the hydrocarbon level of the aftertreatment system 124 is no longer higher, which in control system 200 is when both the SCR 126 is at or above 175 degrees Celsius and the DOC 154 is at or above 175 degrees Celsius. In this embodiment, the idle speed at high idle is 1200 RPM, but the exact speed may vary in other embodiments.

If the ECU 134 proceeded to step 214, it will determine the ULI (Ultra-Low Idle) status, which indicates whether ultra-low idle is enabled or disabled. In this embodiment, the ECU 134 determines this by checking whether the last ULI status communication it received from the VCU 136 enabled ULI or disabled ULI. The ECU 134 therefore watches for ULI messages it receives from the VCU 136 over the CAN, and may update a stored variable as the VCU 136 changes the enablement status of ULI. For example, if the ECU 134 receives CAN message M226, which is a ULI status message from the VCU 136 configured with a ULI disabled payload, then it sets its stored ULI variable to disabled. If the ECU 134 instead receives CAN message M228, which is a ULI status message from the VCU 136 configured with a ULI enable payload, then it sets its stored ULI variable to enabled.

In step 216, the ECU 134 evaluates whether ULI is enabled. If it is enabled, the ECU 134 proceeds to step 218 where the idle speed of the engine 122 is set to ultra-low idle, in this embodiment 700 RPM. If it is disabled, the ECU 134 proceeds to step 220 where the idle speed of the engine 122 is set to low idle, in this embodiment 900 RPM. After executing step 218 or step 220, the ECU 134 returns to step 206 and restarts the control loop.

Meanwhile, the VCU 136 is executing subsystem 204, either synchronously or asynchronously with the subsystem 202. In step 222, the VCU 136 receives CAN message M208 from the ECU 134 which provides the temperature information from the SCR temperature sensor 164 and the DOC temperature sensor 166. The VCU 136 then proceeds to step 224, where it evaluates that temperature information to determine the hydrocarbon level of the aftertreatment system 124. In control system 200, the hydrocarbon level is determined by the VCU 136 by evaluating whether the determined temperatures it received from the ECU 134 are below an associated ULI temperature. In this embodiment, the VCU 136 determines whether the SCR 126 is below 200 degrees Celsius and the DOC 154 is below 200 degrees Celsius (the associated ULI temperatures), which may also be referred to as high temperature thresholds. If either the SCR 126 or the DOC 154 is below its associated ULI temperature, then the VCU 136 determines that the hydrocarbon level is medium (between a hydrocarbon ceiling and a hydrocarbon floor) and it proceeds to step 226, where it sends the CAN message M226 indicating that ultra-low idle is disabled. If neither the SCR 126 nor the DOC 154 is below its associated ULI temperature, then the VCU 136 determines that the hydrocarbon level is low (below a hydrocarbon floor) and proceeds to step 228, where it sends the CAN message M228 indicating that ultra-low idle is enabled. After proceeding to either step 226 or step 228, the VCU 136 then proceeds to step 222 to restart subsystem 204.

Each ULI temperature associated with a component of the aftertreatment system 124 is greater than the minimum aftertreatment temperature associated with that same component. This has the effect of disabling ultra-low idle as the aftertreatment system 124 nears a high hydrocarbon level (near the temperature at which the ECU 134 would transition the idle speed of the engine 122 to a high idle), but before it reaches the high hydrocarbon level (when the temperatures fall below the minimum). This may reduce the number of idle speed transitions to high idle, which may use more fuel than an idle speed of low idle. This may also reduce the number of times the speed of the engine 122 needs to change while the work vehicle 100 is idling.

FIG. 5 is a flowchart of an alternative control system 300 which would be executed by a single controller, which could be either the ECU 134 or the VCU 136, or another controller in different embodiments. In this embodiment, it will be assumed that the control system 300 is being executed by the ECU 134.

In step 302, the ECU 134 determines at least one temperature of the aftertreatment system 124. In this embodiment, the ECU 134 determines the temperature of the SCR 126 using the SCR temperature sensor 164.

In step 304, the ECU 134 determines the hydrocarbon level by evaluating whether the temperature of the SCR 126 determined in step 302 is below its associated minimum aftertreatment temperature of 175 degrees Celsius. If it is, the ECU 134 determines the hydrocarbon level to be high and proceeds to step 306 where it sets the engine idle speed to high idle. In the control system 300, step 306 contains an additional optional feature not present in step 212 of the control system 200, which is to count the ultra-low idle to high idle transitions. More specifically, step 306 increments a stored variable if the existing idle speed is set to ultra-low idle. This stored variable, which can be called count ULI to HI, is reset each time the work vehicle 100 is turned off, which may be referred to as a key cycle. By incrementing the count each time the control system 300 enters step 306 with idle speed set to ultra-low idle and resetting it each time a key cycle happens, the count may be used to represent the number of times the idle speed transitions from ultra-low idle to high idle since the last key cycle. After completing step 306, the ECU 134 proceeds to step 302.

If the hydrocarbon level is not high, and thus the temperature of the SCR 126 is not below the minimum aftertreatment temperature, then the ECU 134 proceeds to step 308. In step 308, the ECU 134 checks the count of the stored variable that is incremented in step 306. If the transition count is two or greater, which may be referred to as a maximum ULI exit count, then the ECU 134 proceeds to step 310 where the idle speed of the engine 122 is set to low idle and then the ECU 134 proceeds to step 302 to restart the control system 300. If the cycle count is below two, then the ECU 134 proceeds to step 312. Step 308 thereby has the effect of disabling ultra-low idle if the ECU 134 has transitioned the idle speed from ultra-low idle to high idle twice in the current key cycle. This optional feature may allow ultra-low idle to be disabled in circumstances where ultra-low idle may be a factor in causing a need for the idle speed to be transitioned to high-idle to increase the temperatures in the aftertreatment system 124.

In step 312, the ECU 134 estimates a future hydrocarbon level using at least one future temperature of the aftertreatment system 124. In this embodiment the ECU 134 estimates the future hydrocarbon level by estimating the temperature of the SCR 126 using a computational model which is based on the trend of the temperature indicated by the SCR temperature sensor 164. The ECU 134 stores the most recent history of the temperatures indicated by the SCR temperature sensor 164, and performs a linear regression on this history to determine the rate at which the temperature is rising or falling. This trend can be extrapolated to estimate the future temperature of the SCR 126. As one example, if the SCR temperature sensor 164 indicated a temperature of 330 degrees Celsius at forty seconds in the past, 329 degrees at thirty seconds in the past, 328 degrees at twenty seconds in the past, 327 degrees at ten seconds in the past, and 326 degrees at the present, the ECU 134 can use a linear extrapolation to estimate that the temperature of the SCR 126 will be 323 degrees at thirty seconds in the future. The complexity of this computational model can be increased in alternative embodiments, which may offer increased accuracy of the estimates in certain circumstances, using additional inputs such as the ambient temperature as indicated by the ambient temperature sensor 138 or the load on the engine 122, or more complex extrapolations such as multi-variate non-linear regression or a neural network tuned for this system, or other techniques known in the art.

In step 314, the ECU 134 evaluates whether the estimated future temperature from step 312 is below the associated minimum aftertreatment temperature, and if it is, determines the hydrocarbon level is medium and proceeds to step 316 to set the idle speed of the engine 122 to low idle. If it determines the estimated future temperature from step 312 will not be below the associated minimum aftertreatment temperature, it determines the hydrocarbon level is low and proceeds to step 318 to set the idle speed of the engine 122 to ultra-low idle. To continue with the example of the prior paragraph, the ECU 134 evaluates whether 323 degrees Celsius is below 175 degrees, and in this example, would proceed to step 318. Step 316 and step 318 both proceed to step 302 next, to restart the control system 300.

FIG. 6 is a flowchart of an alternative control system 400 which would be executed by a single controller, which could be either the ECU 134 or the VCU 136, or another controller in different embodiments. In this embodiment, it will be assumed that the control system 400 is being executed by the ECU 134. In alternative embodiments, the control system 400, like the control system 200 or control system 300, could be adapted to work with one, two, or more controllers.

In step 402, the ECU 134 determines at least one temperature of the aftertreatment system 124. In this embodiment, the ECU 134 determines the temperature of the SCR 126 using the SCR temperature sensor 164.

In step 404, the ECU 134 determines the change in the hydrocarbon level, a hydrocarbon change, using the temperature determined in step 402. In this embodiment, the relationship between the temperature of the aftertreatment system 124 and the associated change in the hydrocarbon level is based on a pre-determined model stored in memory accessible to the ECU 134 in the form of a lookup table which has multiple temperatures and an associated change in the hydrocarbon level. For example, the temperatures in the lookup table could be [150, 200, 250, 300] with the associated change in the hydrocarbon levels being [2, 1, −50, −100], with interpolation or extrapolation used to find the change in the hydrocarbon level when the temperature input is not one of those four exact values. Step 404 may be run on a set interval (e.g., every 10 seconds for this embodiment), or if the control system 400 is executed using dynamic time intervals the change in hydrocarbon level may be multiplied by the time since step 404 was last run, to avoid undesired time effects from affecting the calculated change.

In step 406, the ECU 134 takes the determined change in the hydrocarbon level from step 404, and adds it to the existing value for the hydrocarbon level, which may be a variable stored in memory by the ECU 134, thereby updating the hydrocarbon level. In this embodiment, the ECU 134 does not allow the hydrocarbon level to fall below 0 or rise above 10000, which represent a minimum and maximum for the hydrocarbon level. After step 406, the value stored by the ECU 134 for the hydrocarbon level of the aftertreatment system 124 is indicative of the extent to which hydrocarbons have accumulated in the aftertreatment system 124, similar to how the hydrocarbon level is determined in the control system 200 and the control system 300, but with greater granularity. The lookup table used in step 404 can be adjusted based on the vehicle 100 or aftertreatment system 124, theoretical models, empirical evidence, or combinations thereof, to provide the level of accuracy desired for the determination of the hydrocarbon level.

In step 408, the ECU 134 evaluates whether the hydrocarbon level determined in step 406 is above a hydrocarbon ceiling, which may be 9500 in this example. If so, the ECU 134 proceeds to step 410, and if not, the ECU 134 proceeds to step 412.

In step 410, the ECU 134 sets the idle speed of the engine 122 to high idle, then continues to step 402 to form a loop of the control system 400.

In step 412, the ECU 134 evaluates whether the hydrocarbon level determined in step 406 is below a hydrocarbon floor, which may be 2500 in this example. If so, the ECU 134 proceeds to step 414, and if not, the ECU 134 proceeds to step 416.

In step 414, the ECU 134 sets the idle speed of the engine 122 to ultra-low idle, then continues to step 402 to form a loop of the control system 400.

In step 416, which is reachable if the hydrocarbon level is between the hydrocarbon floor and the hydrocarbon ceiling, the ECU 134 sets the idle speed of the engine 122 to low idle, then continues to step 402 to form a loop of the control system 400.

The control system 400 calculates the hydrocarbon level using a time-at-temperature model, which may be desirable in certain applications if the accuracy of such a model surpasses the accuracy of a temperature threshold model in that application, and if the additional accuracy warrants the additional complexity and calculations needed for such a model. In the control system 400, the hydrocarbon level is an abstract number from 0 to 10000, but in alternative embodiments the minimum, maximum, ceiling, floor, and lookup table values could be chosen differently, for example to match real-world units or as a percent full.

While the control systems 200 and 300 utilize a different method of calculating the hydrocarbon level than the control system 400, all three embodiments can be modified to execute on one, two, or more controllers. All three can also be modified to determine current or future hydrocarbon levels, using current or future temperatures. All three can also be modified to use a temperature threshold determination of hydrocarbon level, as in the control system 200 and the control system 300, or a time-at-temperature model as in the control system 400, or an alternate method of modeling the hydrocarbon level in the aftertreatment system 124.

As used herein, "control unit" and "controller" are intended to be used consistent with how the term is used by a person of skill in the art, and refers to a computing component with processing, memory, and communication capabilities which is utilized to control or communicate with one or more other components. In certain embodiments, various controllers may be referred to a vehicle control unit (VCU), engine control unit (ECU), or transmission control unit (TCU). In certain embodiments, a controller may be configured to receive input signals in various formats (e.g., hydraulic signals, voltage signals, current signals, CAN messages, optical signals, radio signals), and to output command signals in various formats (e.g., hydraulic signals, voltage signals, current signals, CAN messages, optical signals, radio signals).

The VCU 136, which may be referred to as a vehicle control unit (VCU), is in communication with other components on the work vehicle 100, such as hydraulic components, electrical components, and operator inputs. The VCU 136 is electrically connected to these other components by a wiring harness such that messages, commands, and electrical power may be transmitted between these controllers and the other components. For example, the VCU 136 is connected to the ECU 134 through a controller area network (CAN). Each of the ECU 134 and the VCU 136 may also be referred to more generally as a controller or control unit. The VCU 136 may then send commands over the CAN to the ECU 134, and the ECU in turn may receive these commands and actuate solenoids or other components to control the engine 122 based on such commands. In addition to exchanging commands, the VCU 136 and the ECU 134 may exchange information, such as the state of a solenoid or the reading from a sensor.

For the sake of brevity, conventional techniques and arrangements related to signal processing, data transmission, signaling, control, and other aspects of the systems disclosed herein may not be described in detail. Furthermore, the connecting lines shown in the various figures contained herein are intended to represent example relationships and/or connections between the various elements (e.g., electrical power connections, communications, physical couplings). It should be noted that many alternative or additional relationships or connections may be present in an embodiment of the present disclosure.

Without in any way limiting the scope, interpretation, or application of the claims appearing below, a technical effect of one or more of the example embodiments disclosed herein is to conserve fuel by managing when an engine enters an ultra-low idle state to avoid creating issues with emissions control technology.

As used herein, "e.g." is utilized to non-exhaustively list examples, and carries the same meaning as alternative illustrative phrases such as "including," "including, but not limited to," and "including without limitation." As used herein, unless otherwise limited or modified, lists with elements that are separated by conjunctive terms (e.g., "and") and that are also preceded by the phrase "one or more of," "at least one of," "at least," or a like phrase, indicate configurations or arrangements that potentially include individual elements of the list, or any combination thereof. For example, "at least one of A, B, and C" and "one or more of A, B, and C" each indicate the possibility of only A, only B, only C, or any combination of two or more of A, B, and C (A and B; A and C; B and C; or A, B, and C). As used herein, the singular forms "a", "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof.

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A work vehicle comprising:

an internal combustion engine;

an aftertreatment system configured to treat exhaust gas from the engine;

at least one controller in communication with the engine and the aftertreatment system, the at least one controller configured to:

determine a hydrocarbon level of the aftertreatment system;

set an idle speed of the engine to high idle if the hydrocarbon level is above a hydrocarbon ceiling;

set an idle speed of the engine to ultra-low idle if the hydrocarbon level is below a hydrocarbon floor, the hydrocarbon level of the hydrocarbon floor less than the hydrocarbon level of the hydrocarbon ceiling; and set the idle speed of the engine to low idle if the hydrocarbon level is between the hydrocarbon ceiling and the hydrocarbon floor, engine speed at low idle greater than engine speed at ultra-low idle, engine speed at low idle less than engine speed at high idle.

2. The work vehicle of claim 1, wherein the at least one controller is configured to determine the hydrocarbon level using a temperature of the aftertreatment system.

3. The work vehicle of claim 2, wherein the temperature of the aftertreatment system is a sensed temperature provided by a temperature sensor included in the aftertreatment system.

4. The work vehicle of claim 2, wherein the temperature of the aftertreatment system is an estimated current temperature provided by a computational model of the aftertreatment system.

5. The work vehicle of claim 2, wherein the temperature of the aftertreatment system is an estimated future temperature of the aftertreatment system.

6. The work vehicle of claim 2, wherein the temperature of the aftertreatment system is a temperature of a selective catalytic reduction system included in the aftertreatment system.

7. The work vehicle of claim 1, wherein the hydrocarbon level is an estimated future hydrocarbon level.

8. The work vehicle of claim 1, wherein the at least one controller is further configured to:

count the number of times the idle speed of the engine transitions from ultra-low idle to high-idle since a last key cycle; and disable the setting of the idle speed of the engine to ultra-low idle if the count is greater than a maximum ULI exit count.

9. The work vehicle of claim 1, wherein engine speed at ultra-low idle is below 785 RPM, the engine speed at low idle is 785-1049 RPM, and the engine speed at high idle is 1050-1300 RPM.

10. The work vehicle of claim 1, wherein the hydrocarbon level is determined using at least two of an ambient temperature, a load on the engine, and an engine temperature.

11. The work vehicle of claim 1, wherein the hydrocarbon level is below a hydrocarbon floor if the temperature of the aftertreatment system is above a high temperature threshold, the hydrocarbon level is between a hydrocarbon ceiling and the hydrocarbon floor if the temperature of the aftertreatment system is between the high temperature threshold and a low temperature threshold, and the hydrocarbon level is above the hydrocarbon ceiling if the temperature of the aftertreatment system is below the low temperature threshold, the hydrocarbon level of the hydrocarbon ceiling greater than the hydrocarbon level of the hydrocarbon floor.

12. The work vehicle of claim 2, wherein the hydrocarbon level is determined by adding the hydrocarbon change to a previously determined hydrocarbon level, the hydrocarbon change determined using the temperature of the aftertreatment system.

13. The work vehicle of claim 12, wherein the hydrocarbon change is determined using a relationship between the temperature of the aftertreatment system and the hydrocarbon change, the relationship stored in memory on the at least one controller.

14. A method of controlling an internal combustion engine with an aftertreatment system configured to treat exhaust gas from the engine, the method comprising:

determining a current temperature of the aftertreatment system;

estimating, using the current temperature of the aftertreatment system, whether a future temperature of the aftertreatment system will be below a minimum aftertreatment temperature;

setting an idle speed of the engine to high idle if the current temperature of the aftertreatment system is below the minimum aftertreatment temperature;

setting the idle speed of the engine to ultra-low idle if (i) the idle speed is not set to high idle and (ii) the future temperature of the aftertreatment system is estimated to not be below the minimum aftertreatment temperature; and setting the idle speed of the engine to low idle if it is not set to ultra-low idle or high idle, the engine speed at ultra-low idle less than the engine speed at low idle, the engine speed at high idle greater than the engine speed at low idle.

15. The method of claim 14, wherein the current temperature of the aftertreatment system is a sensed temperature provided by a temperature sensor included in the aftertreatment system.

16. The method of claim 15, wherein the temperature sensor is configured to measure a temperature of a selective catalytic reduction system included in the aftertreatment system.

17. The method of claim 14, wherein the future temperature of the aftertreatment system is estimated using the current temperature of the aftertreatment system.

18. The method of claim 14, wherein the future temperature of the aftertreatment system is estimated using at least two of the current temperature of the aftertreatment system, an ambient temperature, and an engine load.

19. The method of claim 14, further comprising:

counting the number of times the idle speed was transitioned from ultra-low idle to high idle since a last key cycle; and disabling ultra-low idle if the count is greater than a maximum ULI exit count.

20. The method of claim 14, wherein the current temperature of the aftertreatment system is a first current temperature of the aftertreatment system, the future temperature of the aftertreatment system is a first future temperature of the aftertreatment system, and the minimum aftertreatment temperature is a first minimum aftertreatment temperature, the method further comprising:

determining a second current temperature of the aftertreatment system, the second current temperature of the aftertreatment system indicative of a temperature of a different portion of the aftertreatment system than the first current temperature of the aftertreatment system;

setting the idle speed of the engine to high idle if the second current temperature of the aftertreatment system is below the second minimum aftertreatment temperature;

estimating whether a second future temperature of the aftertreatment system will not be below a second minimum aftertreatment temperature, the first future temperature of the aftertreatment system indicative of a temperature of a different portion of the aftertreatment system than the second future temperature of the aftertreatment system; and setting the idle speed of the engine to ultra-low idle if (i) the idle speed is not set to high idle, (ii) the first future temperature of the aftertreatment system is estimated to not be below the first minimum aftertreatment temperature, and (iii) the second future temperature of the aftertreatment system is estimated to not be below the second minimum aftertreatment temperature.

* * * * *